United States Patent [19]

Brown

[11] 4,120,612

[45] Oct. 17, 1978

[54] AUTOMATIC PUMP FOR DEEP WELLS

[76] Inventor: Kenard D. Brown, 1227 S. Willow St., Casper, Wyo. 82601

[21] Appl. No.: 651,512

[22] Filed: Jan. 22, 1976

[51] Int. Cl.[2] ..... F04B 9/10

[52] U.S. Cl. ..... 417/53; 417/392; 417/390

[58] Field of Search ..... 417/40, 53, 390, 392, 417/329

[56] References Cited

U.S. PATENT DOCUMENTS

| | | | |
|---|---|---|---|
| 1,381,562 | 6/1921 | Jones | 417/392 |
| 2,626,569 | 1/1953 | Knudson | 417/390 |
| 2,770,197 | 11/1956 | Deitrickson | 417/390 |
| 2,942,552 | 6/1960 | Wayt | 417/390 |
| 3,050,006 | 8/1962 | Wolf | 417/390 |
| 3,091,181 | 5/1963 | Wolf | 417/390 |
| 3,164,095 | 1/1965 | Williams | 417/40 |
| 3,521,445 | 7/1970 | Grable | 417/329 |
| 3,589,838 | 6/1971 | Tuzson | 417/390 |

*Primary Examiner*—William L. Freeh
*Attorney, Agent, or Firm*—Wm. Griffith Edwards

[57] ABSTRACT

An automatic pump for deep wells comprises a long stroke reciprocating pump having its piston normally in its bottom position and an automatic control dependent upon the collection of a predetermined amount of liquid in the pump cylinder above the piston for actuating the piston to pump the liquid into a production line. The automatic control includes a hydraulic pump and a reservoir of hydraulic fluid which is actuated upon filling of the reciprocating pump chamber to supply hydraulic fluid to a closed chamber below the piston and force the piston upwardly to discharge liquid from the pump cylinder. The hydraulic pump is reversed automatically upon completion of the pumping stroke of the piston.

16 Claims, 5 Drawing Figures

AUTOMATIC PUMP FOR DEEP WELLS

This invention relates to an improved down hole pump for oil wells and the like and particularly to a deep well pump for oil field use which is automatic in operation and pumps at a rate determined by the rate of flow of the liquid of the well in which it is installed.

The present invention is an improvement on the invention of my U.S. Pat. No. 3,225,697 issued Dec. 28, 1965.

The deep well pump disclosed in my above patent has provided a system whereby liquids are pumped from the well only after a predetermined volume of liquid has entered the pump cylinder from the formation in which the well is located. Thus power is used only when the predetermined volume of liquid has been accumulated; this represents a substantial saving of energy over that expended for continuous low volume production pump operation. It is an object of my present invention to provide an improved deep well pump of the type which operates only in response to a predetermined accumulation of liquid.

It is another object of my invention to provide a deep well pump of the automatic type including an improved arrangement for reducing the cost of the equipment and the energy expended thereby.

It is another object of my invention to provide an automatic deep well pump which is actuated in response to the accumulation of a predetermined amount of liquid in the pump cylinder and including an improved operating mechanism for the pump.

It is another object of my invention to provide an automatic deep well pump including an improved arrangement utilizing an electric motor in the pump assembly for actuating the pump.

Briefly, in carrying out the objects of my invention in one embodiment thereof, I provide a long stroke reciprocating pump and a hydraulic reservoir and a driving assembly including a hydraulic pump and an electric motor for driving the hydraulic pump; the hydraulic pump delivers fluid from the reservoir which is mounted in the assembly above the long stroke pump. The fluid is delivered to a closed chamber below the piston of the reciprocating pump; when energized, the electric motor drives the hydraulic pump to deliver hydraulic fluid to the closed chamber and drives the piston upwardly thereby delivering the liquid from the cylinder to a production line. Check valves at the discharge end of the pump cylinder prevent reverse flow of the liquid. The upward movement of the reciprocating piston is limited by a switch which reverses the hydraulic pump at a predetermined point, thus reversing the piston and returning the hydraulic fluid to the reservoir. The upper portion of the reservoir may contain a quantity of nitrogen or other neutral gas, which provides a surge chamber action, the return of the fluid compressing the gas to the extent necessary.

The features of novelty which characterize this invention are pointed out with particularity in the claims annexed to and forming a part of this Specification. The invention itself, however, both as to its construction and manner of use, together with further objects and advantages thereof, will best be understood upon reference to the following description taken in connection with the accompanying drawings in which:

Figure 2:
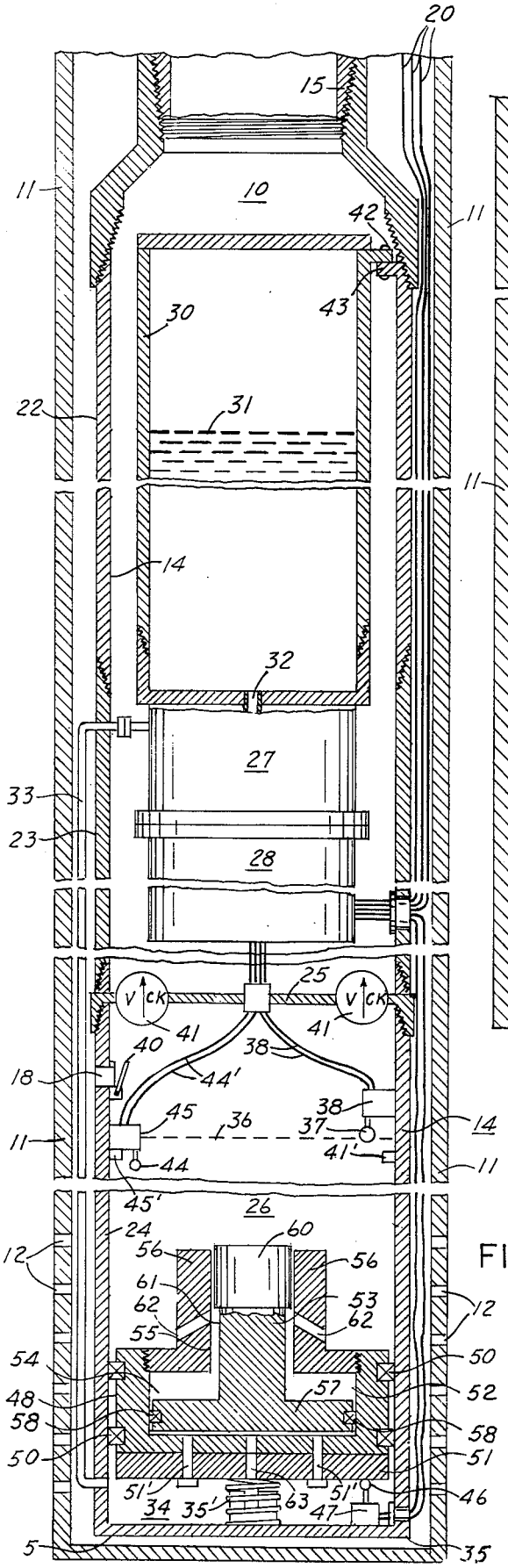
FIG. 2 is an enlarged somewhat diagrammatic sectional elevation view of the pump of FIG. 1.
Figure 2A:
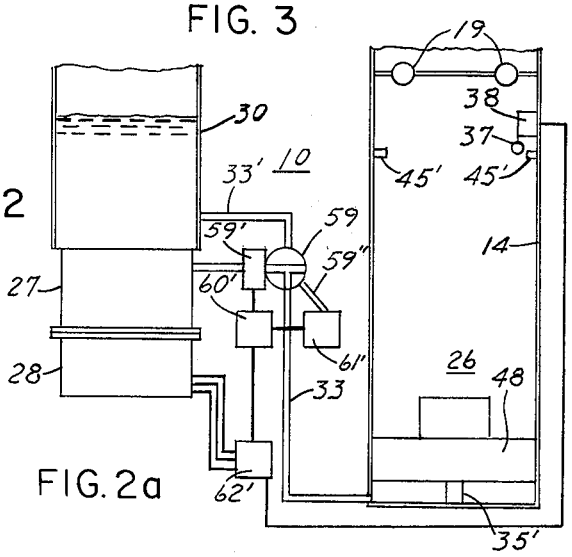

FIG. 2*a* is a diagrammatic illustration of a modified arrangement of the pump control.

Figure 4:
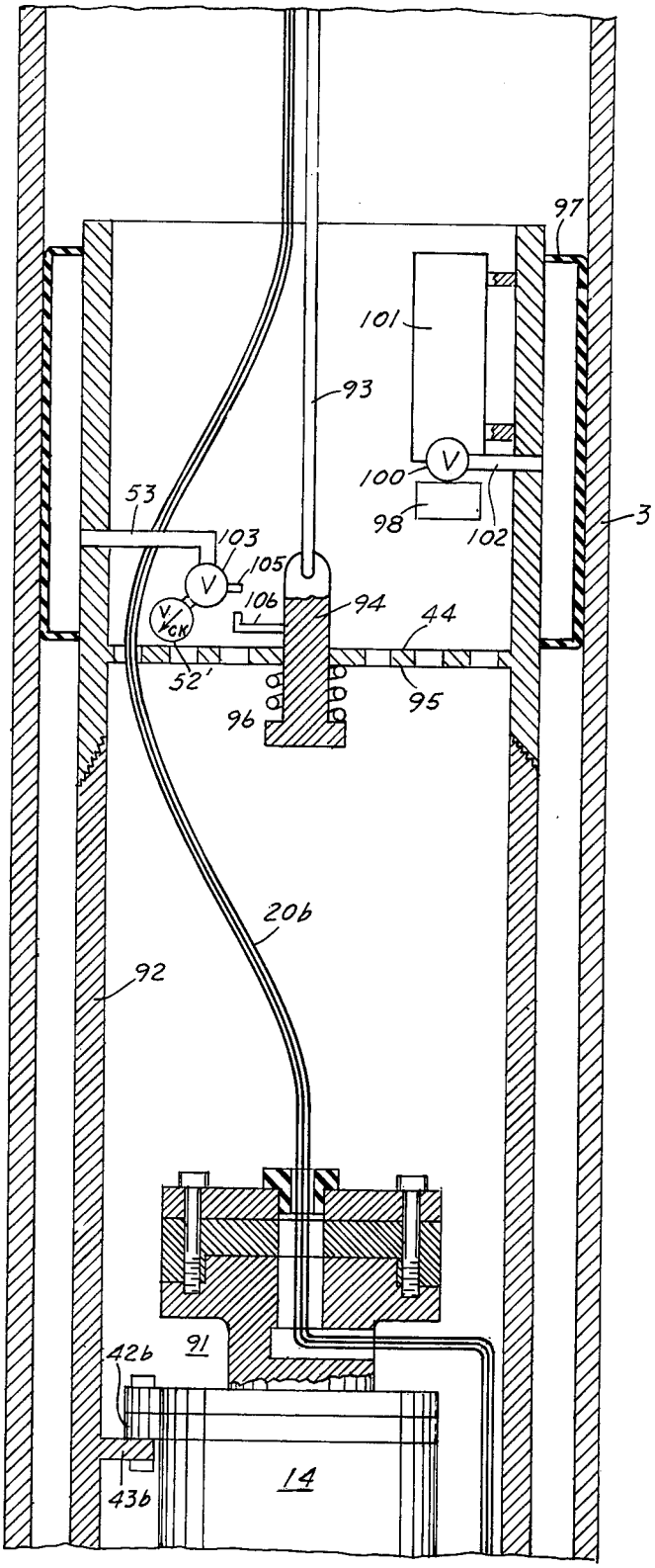
Figure 3:
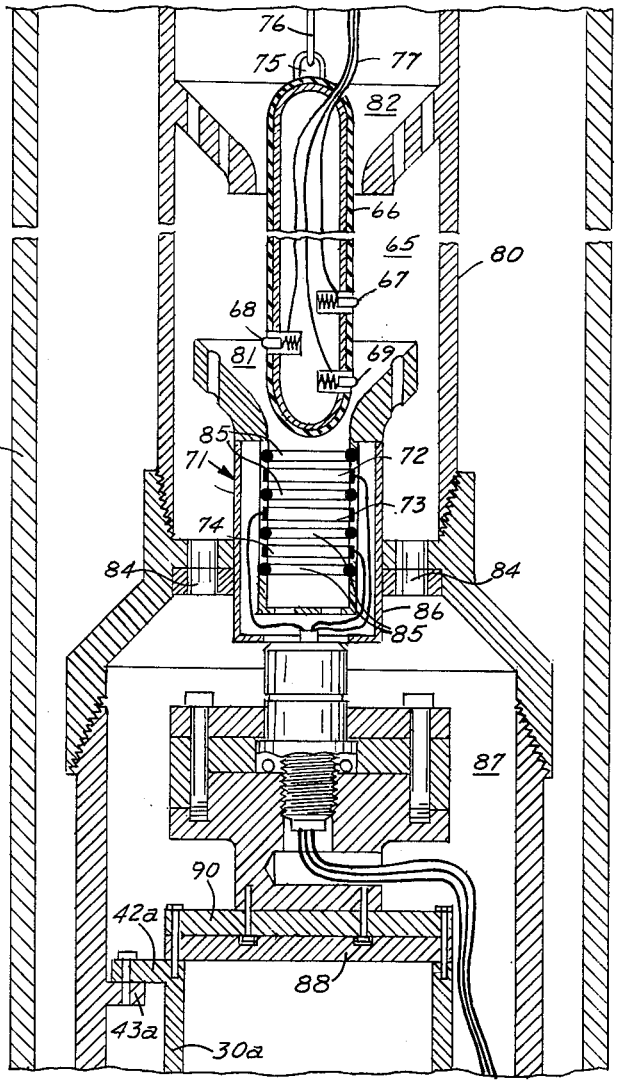

FIG. 3 is an enlarged sectional elevation view similar to FIG. 2 illustrating a modification of the pump assembly;

FIG. 4 is an enlarged sectional elevation view similar to FIG. 3 illustrating a further embodiment of the invention.

The deep well pump of this invention is constructed so that it may be made with a long stroke, for example, fifty feet or more, and so that the pump is actuated only when the pump cylinder has been filled with liquid to a predetermined level; thus the pump is actuated to deliver liquid in accordance with the rate of the supply of the liquid and in units of volume each equal to the cylinder capacity.

Figure 1:
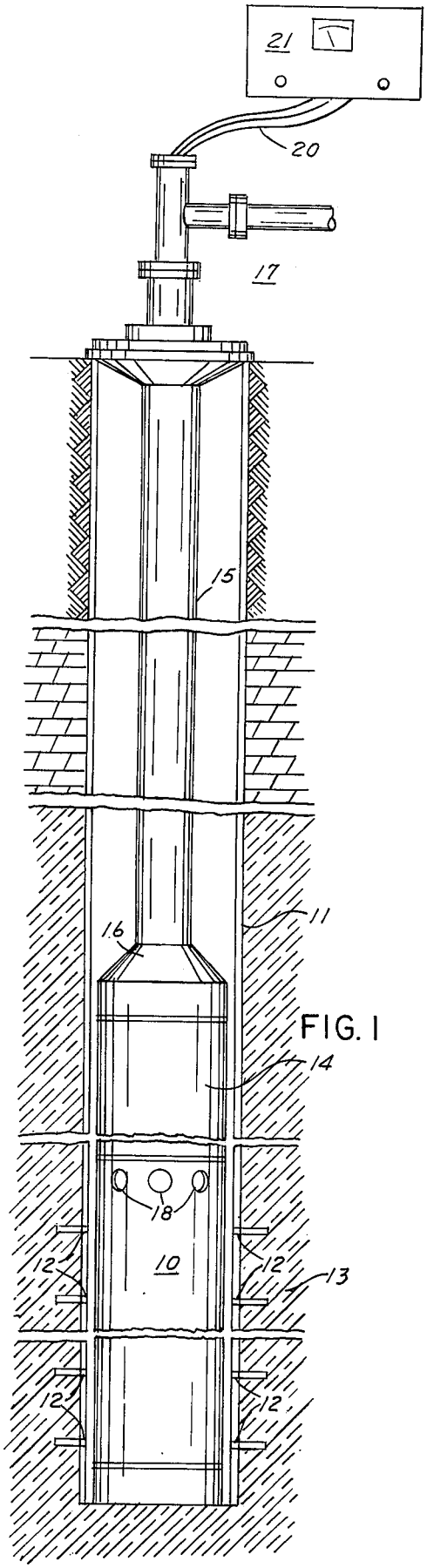
FIG. 1 is a diagrammatic sectional elevation view of a cased well in a reservoir formation having installed therein a deep well pump embodying the invention.

Referring now to the drawings, FIG. 1 illustrates a pump assembly 10 which is positioned within a well casing 11.

The casing is perforated to provide a multiplicity of inlet openings 12 adjacent a producing formation 13; the shot holes extend from the openings 12 into the formation for delivering formation fluids to the interior of the casing. The pump assembly includes a cylindrical housing 14 which is rigidly secured to and supported from a production tubing 15 by a reducing fitting 16. The tubing is suspended from a well head assembly 17. Fluids from the formation enter the casing and, on reaching a plurality of openings 18 in the housing 14, enter the housing where the liquid is accumulated and then pumped to the surface.

Power for driving the pump in the assembly is supplied through three-phase alternating current lines 20 from a conventional power source through a control unit 21. In this embodiment, the lines 20 pass through the production tubing to the pump assembly.

Both the pump assembly 10 and the tubing 15 have been shown with breaks, since both the assembly and the tubing are of much greater length than can be illustrated in proportion in the drawing.

In this figure, the power lines 20 have been illustrated as lying outside the production tubing and pump assembly housing and pass into the housing through suitable insulating seals. The lines 20 preferably are tied to the production tubing.

The internal arrangement of the pump assembly is shown in FIG. 2; the housing 14 is cylindrical and has been illustrated as comprising upper, middle and lower sections 22, 23 and 24, respectively, which are threaded together by tapered threads in accordance with well known practice. The middle and lower sections are connected by a plate fitting 25 which constitutes a partition between these sections and divides the housing 14 into an upper chamber and a lower chamber. The lower chamber, which is entirely within the section 24, is the cylinder of the deep well pump, and a free piston assembly 26 is installed for reciprocation in the cylinder 24; this assembly being biased by gravity to its lowermost position in the housing. The upper chamber, which is defined by the two sections 22 and 23 has therein a hydraulic pump 27, an electric drive motor therefor, and a reservoir or tank 30, which is filled with hydraulic fluid either completely or to a level such as indicated at 31. The reservoir above the liquid may be filled with a neutral gas such as nitrogen. The pump 27 is connected to receive liquid from the tank 30 through an inlet 32 and to deliver liquid through a supply line 33 to an expansible chamber 34 below the piston assembly 26, the bottom of the housing 14 being closed by an end plate 35. In its lowermost position, the pump assembly 26 rests on a spring seat 35, which determines the minimum volume of the expansible chamber 34.

During the operation of the pump assembly, as liquid flows through the openings 18 into the chamber above the piston assembly, it fills the chamber until it reaches a level indicated by a dotted line at 36 which is below the level of the openings 18. Gas also may enter the chamber and accumulates above the liquid. When the liquid reaches the level 36, a float 37 rises and actuates a switch 38, which is connected by leads 38' to the pump motor control and when actuated operates to start the motor 28 and drive the hydraulic pump 27. The motor has been illustrated with a break because the motor is of the deep well type and may be very long as compared with its diameter. The operation of the hydraulic pump produces a flow of high pressure liquid into the chamber 34 and the piston assembly is driven upwardly increasing the pressure in the pump cylinder, actuating check valves 40 to close the openings 18, and delivering fluids through check valves 41 in the partition 25, the fluids being delivered to the production tubing 15. The hydraulic pump and reservoir assembly is suspended within the housing 14 on a plurality of lugs or hangers, one of which is shown at 42 as bolted to an upwardly extending lug 43 at the top end of the section 22. The fluids flow freely upwardly through spaces between the hangers and lugs.

When the piston assembly reaches its top position, it engages an operating element 44 of a limit switch 45; the switch is connected by leads 45' to the pump control and the operation of the switch effects control of the hydraulic pump to reverse the flow of hydraulic fluid. The hydraulic fluid is thus withdrawn from the expansible chamber below the piston assembly 26 and returned to the reservoir 30. This reversal of flow may be accomplished by selecting a reversible pump which is reversed by reversing the electric motor or by providing reversing connections in the hydraulic circuit at the pump, either type of reversal being effected by operation of the limit switch 45 or another method of reversing the hydraulic fluid flow, the piston will strike a rigid stop 45' which may be an annular ring rigidly mounted on the inside wall of the section 24. This stopping of the piston will produce an abrupt rise in the pressure of the hydraulic liquid below the piston, and in the hydraulic pump which will actuate the high pressure control of the hydraulic pump 27 to relieve the excess pressure.

Upon reversal of the flow of hydraulic fluid, the piston assembly 26 returns toward its bottom position by gravity assisted by the removal of hydraulic liquid from below the piston, and upon engaging the actuator 46 of a switch 47 stops the motor 28 until another full load of liquid accumulates in the pump chamber.

As shown in FIG. 2, the piston assembly 26 comprises a main piston 48 mounted for sliding movement in the cylinder 24. Leakage between the top and bottom sides of the piston 48 is prevented by suitable annular gaskets or rings 50 mounted in annular grooves about the piston. The piston assembly may be weighted by adding a plate or disc, as illustrated at 51 to facilitate its return to its lowermost position. The disc is illustrated as secured to the piston by bolts 51'.

During the operation of the pump assembly, the fluids entering the pump chamber through the openings 18 may carry some sand or other sediment into the chamber and this foreign matter will tend to settle in the bottom of the chamber on top of the piston assembly 26. In order to minimize the collection of sediment in the pump chamber, a device for agitating the sediment and creating turbulance is provided. For this purpose, the pump assembly 26 is constructed by forming the main piston as an upwardly opening cup thereby providing an internal cylindrical chamber 52 in which a piston 53 is slidably mounted. The chamber 52 includes a large diameter portion 54 and a reduced diameter portion 55; these cylinder portions are formed by a flanged cylindrical member 56 threaded in the larger diameter portion of the main piston. The piston 53 includes a portion 57 fitting the cup 54 and provided with sealing rings 58 to prevent leakage, and a reduced portion 60 extending upwardly through the reduced diameter portion 55 of the chamber 52. The upper portion 60 of the piston 53 acts as a guide and a reduced portion 61 provides communication between the larger diameter chamber or cup 54 and a plurality of downwardly inclined discharge passages 62.

When the operation of the hydraulic pump starts, high pressure liquid is admitted to the chamber 34 and immdiately is applied to the lower side of the piston 57 through a port 63, which passes through the weighting disc 51 and the bottom of the main piston 48. This first application of the high pressure liquid forces the piston 53 suddenly upwardly and discharges liquid through the ports 62; the resulting downwardly directed jets of liquid create turbulence and agitate sediment lying on the top of the main piston and facilitate the discharge of the sediment with the liquid forced through the check valves 41, thereby preventing excessive accumulation of sediment and the trapping of sediment in the pump.

The control system illustrated in FIG. 2*a* is arranged to utilize the high pressure control of the hydraulic pump for initiating the return stroke of the piston. In this figure, the structural parts are designated by the same numerals as in FIG. 2. A control valve 59 is provided in the hydraulic fluid supply line 33 to deliver fluid from the pump 27 to the chamber 34 below the piston when the valve is in the position indicated; when the valve is turned 90° counterclockwise, the line 33 is connected to a line 33' to connect the chamber 34 directly to the reservoir for the return of fluid.

During the operation of the system of FIG. 2*a*, when the piston 48 has been driven to its uppermost position, it strikes the stop 45' and the immediate pressure surge actuates a pressure sensitive control 59' which actuates relay 60' which energizes a solenoid 61' to move the valve by an arm 59' and shift the valve 59 to bypass the pump 27 and return fluid from the chamber 34 to the reservoir 30. At the same time, the relay 60' opens a switch 62' to de-energize the motor 28. The piston moves downwardly by gravity to force liquid from the chamber 34 to the reservoir until the piston comes to rest on the spring-stop 35'. The motor remains de-energized until the cylinder 14 has been filled with liquid to the level at which the float switch 38 operates. The motor 27 is thus started and the cycle is repeated.

The embodiment of the invention illustrated in FIG. 3 provides an arrangement whereby the electrical connections to the motor and its control are made through a detachable mandrel or plug which may be lowered on a wire line into position on the pump assembly. As shown in this figure, the plug or mandrel is indicated at 65. It is shaped as an elongated cartridge of cylindrical configuration with rounded ends. The outside wall of the mandrel is provided with a coating 66 of a relatively soft rubber or plastic which is bonded to the surface of the mandrel shell. Three spring biased contacts 67, 68 and 69 are provided in the lower portion of the mandrel and are arranged so that when the mandrel is in position in a socket or receiver assembly 71, they engage three annular contact rings 72, 73 and 74, respectively. The mandrel is provided with an attaching loop or ring 75 for securing a wire line 76 and the cable conductor comprising three electrical leads indicated at 77 provides three phase power and is secured to the wire line and enters the top of the mandrel for connection with the contacts 67, 68 and 69. The mandrel is guided and positioned by an upper cone-shaped receiver 78 mounted on the inner walls of a production tubing 80 and a lower funneled or flared entrance element 81 formed as a part of the receiver assembly 71.

When the mandrel 65 is lowered into the well through the production tubing 80, it is first centered by an upper flared guide 82 and then moves downwardly through the flared entrance element 81 and into the plug socket of the receiver assembly 76. Because of its configuration and weight, the mandrel is seated within the socket in a position such that the contacts 67, 68 and 69 are in engagement with the contact rings 72, 73 and 74, respectively. A supporting structure or spider 83 is provided for supporting the socket assembly 71 and is provided with openings 84 for affording a passage for liquid from the pump assembly below up into the production tubing 80.

The socket or receiver assembly 71 comprises a double walled cup-like structure to which the bottom edge or face of the flared receiver 81 is securely attached. The outer wall indicated at 86 is welded or otherwise rigidly secured to the supporting spider, and the spaced walls provide protection for the electric leads which are connected to the electric motor of the pumping unit through a fitting 87 mounted on the top of the hydraulic fluid reservoir indicated at 30*a*, the reservoir being closed by an end plate 88 and attached to the fitting 87 by means of an intermediate plate 90. Openings in the bottoms of both cup-like walls provide free passage for fluids when the mandrel is moved into or removed from the socket assembly. The fluids from the pump flow upwardly through openings between hanger lugs 42*a* which are supported on lugs 43*a* as are the lugs 43 in FIG. 2.

The guide members 81 and 82 are also provided with perforations to afford upward passage of the produced liquid. This arrangement provides protection for the electrical conductor 77 and provides for the ready disconnection of the electric current supply. The internal wall of the socket of the assembly 71 is provided with a plurality of pairs of "*o*" rings 85 which engage the soft rubber wall of the mandrel, and provide an effective seal between adjacent conductors when the mandrel is in position.

In the modification illustrated in FIG. 4, an arrangement is provided whereby the entire pump assembly may be installed in the well casing on a wire line. As shown in this figure, a pump assembly embodying the invention, and indicated at 91, is mounted by means of lugs and supports 42*b* and 42*c* within a cylindrical housing 92 and is lowered into the well on a wire line 93. The wire line is secured to a spring biased plunger 94, which is slidably mounted at the center of a wall or partition 95 welded or otherwise secured to the inner seal of the housing 41. A spring 96 urges the wall downwardly and is compressed by the weight of the pump assembly when the wire line is under tension. The electric supply cable 20*b* which may be tied to the wire line passes through an opening in the plate 95 and thence to the pump assembly 91.

An expansible packer 97 is mounted about the housing 92 above the partition 95 and is arranged to be inflated when the pump is in position in the well. The inflation of the packer is controlled by a timer 98 which is set to activate a valve 100 at a predetermined time after the pump has reached the position where it is to be installed and releases gas under pressure from a tank 101 to the packing through an inlet pipe 102; when inflated, the packer seals off the well casing below it. A valve 103 is provided in order to open and close an exhaust pipe 104 between the packer and the interior of the housing above the partition. This valve is actuated by movement of the plunger 94 with respect to the partition 95; for this purpose the valve is provided with an actuating arm 105 which lies in the path of an arm 106 on the plunger.

When the pump assembly is in position and the wire line is slacked off, the plunger 94 is in the position shown in FIG. 4 with the arms 105 and 106 out of engagement and the valve 103 closed. When the wire line 93 is pulled upwardly, the plunger moves up until the spring 96 is fully compressed - in this position the arm 106 has moved the arm 105 upwardly to open the valve 52 and release the gas charge from the packer. The packer having been released, the pump assembly may now be pulled from the wall.

This packer construction enables the pump assembly to be installed easily before actuating the packer and to be removed without interference from the packer.

The pump assembly of this invention is easily installed in cased wells, operates only when there is sufficient liquid for pumping and thus provides economy in installation and in operation.

Various other applications and modifications of this invention will occur to those skilled in the art and while specific embodiments have been illustrated and described, it is not desired to limit the invention thereto and it is intended, by the appended claims, to cover all modifications within the spirit and scope of this invention.

I claim:

1. In a deep well pump assembly of the type including an upwardly extending cylinder having therein a reciprocating piston for receiving liquid from a reservoir formation and delivering liquid to the surface and means for actuating the piston dependent upon the accumulation of a predetermined quantity of liquid in said cylinder above the piston, the improvement which comprises:

means including a hydraulic pump mounted in said assembly and having its outlet connected to deliver liquid to said cylinder below said piston for driving said piston upwardly in said cylinder to discharge fluid from said cylinder, said cylinder below said piston constituting an expansible chamber, said means dependent upon the accumulation of a predetermined quantity of liquid in said cylinder above said piston including a sensor in said cylinder for detecting the level of liquid therein and connected to initiate the operation of said hydraulic pump, and means actuated by said piston at the upper end of its stroke and controlling said piston driving means for returning said piston to its bottom position in said cylinder.

2. The invention of claim 1 including an electric motor for driving said hydraulic pump and wherein said means dependent upon a predetermined quantity of liquid in said cylinder includes a float actuated switch for controlling said motor.

3. The invention of claim 1 wherein said means actuated by said piston includes a switch having an operating member in the path of said piston.

4. The invention of claim 1, wherein said hydraulic pump includes an over-pressure release, and said assembly includes a rigid stop in the path of said piston for stopping said piston in the event of failure of said piston return control, whereby said over-pressure release operates to prevent excessive high pressure of the hydraulic fluid.

5. The invention of claim 1, including a hydraulic pump release switch at the bottom of said expansible chamber for stopping said hydraulic pump upon return of said piston to its bottom position.

6. The invention of claim 1, wherein said assembly includes a hydraulic fluid reservoir, and said means actuated by said piston at the upper end of said stroke comprises a stop in said cylinder in the path of said piston, pressure sensing means on the outlet side of said hydraulic pump subject to the pressure of the fluid at the outlet of said hydraulic pump, and means utilizing said pressure sensing means and dependent upon a surge of pressure upon engagement of said piston with said stop for providing open communication between said expansible chamber and said reservoir, whereby said piston returns by gravity to its lowermost position in said cylinder and the hydraulic fluid is returned to said reservoir.

7. The invention of claim 6 including an electric motor for driving said hydraulic pump and second means dependent upon said surge of pressure for de-energizing said motor.

8. In a deep well pump assembly of the type including an upwardly extending cylinder having therein a reciprocating piston for receiving liquid from a reservoir formation and delivering liquid to the surface and means for actuating the piston dependent upon the accumulation of a predetermined quantity of liquid in said cylinder above the piston, the improvement which comprises:

means including a hydraulic pump mounted in said assembly and having its outlet connected to deliver liquid to said cylinder below said piston for driving said piston upwardly in said cylinder to discharge fluid from said cylinder, said cylinder below said piston constituting an expansible chamber, said means dependent upon the accumulation of a predetermined quantity of liquid in said cylinder above said piston including a sensor in said cylinder for detecting the level of liquid therein and connected to initiate the operation of said hydraulic pump, means actuated by said piston at the upper end of its stroke and controlling said piston driving means for returning said piston to its bottom position in said cylinder, said piston including an internal cylinder and means for admitting liquid thereto from above said piston and a second piston mounted for reciprocation in said internal cylinder and being biased to a bottom position, means for admitting hydraulic fluid under pressure to the underside of said second piston for forcing said second piston upwardly in said internal cylinder to discharge liquid therefrom, and means for directing the discharged liquid downwardly toward the top of said first piston to agitate the liquid adjacent thereto.

9. A deep well pump assembly, including an elongated cylindrical housing for insertion in a well casing adjacent a liquid producing formation, said housing having a partition therein dividing it into an upper chamber and a lower chamber, means for delivering fluids from said housing to the surface, means for affording a flow of fluid from said lower chamber to said upper chamber and including means for preventing a reverse flow of fluid, a piston mounted in said lower chamber for reciprocation therein, means closing the bottom end of said housing for providing a closed expansible chamber below said piston, a hydraulic pump mounted in said upper chamber, an electric motor for driving said hydraulic pump, a hydraulic fluid reservoir mounted on said housing in said upper chamber, means for connecting said hydraulic pump to receive fluid from said reservoir and to deliver fluid to said expansible chamber to drive said piston upwardly in said lower chamber and to pump fluids through said upper chamber to the surface, means for admitting fluids from a reservoir formation to the upper portion of said lower chamber and for preventing reverse flow to the formation, means dependent upon the accumulation of liquid in said lower chamber to a predetermined level for initiating the operation of said hydraulic pump to drive said piston upwardly, means dependent upon movement of said piston to a predetermined upper postion for actuating said hydraulic pump to return fluid from said expansible chamber to said reservoir and for returning said piston to its bottom position, and means dependent upon movement of said piston to its bottom position for stopping operation of said hydraulic pump.

10. A deep well pump assembly as set forth in claim 9, wherein said means for initiating operation of said hydraulic pump includes a float actuated switch at said predetermined liquid level in said lower chamber for energizing said electric motor to drive said hydraulic pump, and said means for actuating said hydraulic pump to return fluid to said reservoir includes a switch at the upper end of said lower chamber having an actuating element in the path of said piston for controlling said electric motor to initiate the return stroke of said piston.

11. A deep well pump assembly, including an elongated cylindrical housing for insertion in a well casing adjacent a liquid producing formation, said housing having a partition therein dividing it into an upper chamber and a lower chamber, means for delivering fluids from said housing to the surface, means for affording a flow of fluid from said lower chamber to said upper chamber and including means for preventing a reverse flow of fluid, a piston mounted in said lower chamber for reciprocation therein, means closing the bottom end of said housing for providing a closed expansible chamber below said piston, a hydraulic pump mounted in said upper chamber, an electric motor for driving said hydraulic pump, a hydraulic fluid reservoir mounted on said housing in said upper chamber, means for connecting said hydraulic pump to receive fluid from said reservoir and to deliver fluid to said expansible chamber to drive said piston upwardly in said lower chamber and to pump fluids through said upper chamber to the surface, means for admitting fluids from a reservoir formation to the upper portion of said lower chamber and for preventing reverse flow to the formation, means dependent upon the accumulation of liquid in said lower chamber to a predetermined level for initiating the operation of said hydraulic pump to drive said piston upwardly, means dependent upon movement of said piston to a predetermined upper position for actuating said hydraulic pump to return fluid from said expansible chamber to said reservoir and for returning said piston to its bottom position, means dependent upon movement of said piston to its bottom position for stopping operation of said hydraulic pump, means for suspending said assembly on a wire line for insertion in a well casing, an inflatable packer attached about said housing above said means for admitting fluid to said lower chamber, and means within said upper chamber for inflating said packer after release of tension on the wire line for providing a seal between said housing and the well casing, said inflating means including a cylinder of gas under pressure and means for releasing the gas to inflate the packer at a predetermined time after insertion of the pump assembly in a well, and valve means dependent upon the tensioning of the wire line for releasing the gas from said packer.

12. A deep well assembly including an elongated cylindrical housing for insertion in a well casing adjacent a liquid producing formation, said housing having a partition therein dividing it into an upper chamber and a lower chamber, means for delivering fluids from said housing to the surface, means for affording a flow of fluid from said lower chamber to said upper chamber and including means for preventing a reverse flow of fluid, a piston mounted in said lower chamber for reciprocation therein, means closing the bottom end of said housing for providing a closed expansible chamber below said piston, a hydraulic pump mounted in said upper chamber, an electric motor for driving said hydraulic pump, a hydraulic fluid reservoir mounted on said housing in said upper chamber, means for connecting said hydraulic pump to receive fluid from said reservoir and to deliver fluid to said expansible chamber to drive said piston upwardly in said lower chamber and to pump fluids through said upper chamber to the surface, means for admitting fluids from a reservoir formation to the upper portion of said lower chamber and for preventing reverse flow to the formation, means dependent upon the accumulation of liquid in said lower chamber to a predetermined level for initiating the operation of said hydraulic pump to drive said piston upwardly, means dependent upon movement of said piston to a predetermined upper position for actuating said hydraulic pump to return fluid from said expansible chamber to said reservoir and for returning said piston to its bottom position, means dependent upon movement of said piston to its bottom position for stopping operation of said hydraulic pump, said means for delivering fluids including means for connecting said housing to a fluid production line, an electric cable for supplying current to said electric motor, an electric connection and guide socket mounted at the top of said assembly guide above and spaced from said guide socket and an elongated mandrel constructed to be lowered on a wire line and to be directed into said socket, and complementary electric contact members in said guide socket and on said mandrel for completing electrical connections to said motor, said mandrel having an electric cable connected to its contacts and arranged to extend along the wire line.

13. In a deep well pump assembly of the type including an upwardly extending cylinder having therein a free reciprocatable piston for receiving liquid from a reservoir formation and delivering liquid to the surface and means for actuating the piston dependent upon the accumulation of a predetermined quantity of formation liquid in the cylinder above the piston, the improvement which comprises:

means including a hydraulic pump mounted in said assembly and having its outlet connected to deliver liquid to said cylinder below said piston for driving said piston upwardly in said cylinder to discharge fluid from said cylinder, said cylinder below said piston constituting an expansible chamber, means including a liquid level sensor in said assembly adjacent the top of said cylinder and responsive to a liquid level dependent upon a predetermined filling of said cylinder for starting said pump, and means in the upper end of said cylinder and actuated by said piston at the upper end of its stroke and controlling said piston driving means for returning said piston to its bottom position in said cylinder.

14. A deep well pump assembly as set forth in claim 13, including means for suspending said assembly on a wire line for insertion in a well and operation therein.

15. A deep well pump assembly as set forth in claim 13, including an electric motor in said assembly for driving said pump, a stop for limiting the upward movement of said piston, and means dependent upon a surge of pressure upon engagement of said piston with said stop for deenergizing said motor.

16. In a deep well pump assembly of the type including an upwardly extending cylinder having inlet and outlet valves in the upper portion thereof and a piston reciprocable therein and biased by gravity toward its lowermost position, the assembly being positionable in a well bore for receiving liquid from a reservoir formation and for delivering the liquid to the surface and means for actuating the piston dependent upon the accumulation of a predetermined amount of reservoir liquid in the cylinder above the piston, the method of operation which comprises:

a. providing within the assembly a source of liquid under pressure;

b. allowing liquid from the formation to enter the cylinder until a quantity of reservoir liquid has accumulated in the cylinder above the piston to a predetermined level;

c. upon attainment of said predetermined level supplying liquid under pressure from the source to the cylinder below the piston to drive the piston upwardly and discharge the accumulated liquid from the cylinder;

d. after discharge of the accumulated liquid stopping the supply of liquid under pressure for releasing the pressure below the piston and allowing the piston to return to its lowermost position and returning the liquid from below the piston to the source; and e. repeating the steps of accumulating formation liquid to the predetermined level, driving the piston upwardly and discharging the accumulated reservoir liquid from above the piston, and returning the piston to provide continued production of the reservoir liquid.

* * * * *